US012115575B2

(12) United States Patent
Kim et al.

(10) Patent No.: US 12,115,575 B2
(45) Date of Patent: Oct. 15, 2024

(54) METHOD OF MANUFACTURING OF FORGED ALUMINUM WHEEL

(71) Applicant: ST ENTER CO., LTD., Gimje-si (KR)

(72) Inventors: Gwan Muk Kim, Daejeon-si (KR); Sung Yoon, Jeonju-si (KR)

(73) Assignee: ST ENTER CO., LTD., Gimje-si (KR)

( * ) Notice: Subject to any disclaimer, the term of this patent is extended or adjusted under 35 U.S.C. 154(b) by 0 days.

(21) Appl. No.: 17/994,373

(22) Filed: Nov. 27, 2022

(65) Prior Publication Data

US 2023/0234120 A1 Jul. 27, 2023

(30) Foreign Application Priority Data

Jan. 21, 2022 (KR) ..... 10-2022-0008963

(51) Int. Cl.
*B21K 1/28* (2006.01)

(52) U.S. Cl.
CPC ..... *B21K 1/28* (2013.01)

(58) Field of Classification Search
CPC ..... B21K 1/28; B21K 1/38; B21K 1/00; B21J 1/06; B21J 5/002; B21J 1/00; B21J 5/00
See application file for complete search history.

(56) References Cited

U.S. PATENT DOCUMENTS 3,263,315 A * 8/1966 O'Brien ..... B60B 11/04 72/267
3,478,560 A * 11/1969 O'Brien ..... B21K 1/28 72/267
4,055,068 A * 10/1977 Lucas ..... B21K 1/28 72/364
4,693,630 A * 9/1987 Giovannetti ..... F16B 7/046 403/231
5,446,962 A * 9/1995 Matossian ..... B60B 3/02 72/356
6,757,976 B2 * 7/2004 Baek ..... B23P 15/00 29/894.353

(Continued)

FOREIGN PATENT DOCUMENTS

KR 10-0748757 B 8/2007
KR 10-1303854 B 9/2013

(Continued)

*Primary Examiner* — Lawrence Averick
(74) *Attorney, Agent, or Firm* — Law Offices of Albert Wai-Kit Chan, PLLC

(57) ABSTRACT

The present disclosure relates to a manufacturing method of an aluminum forging wheel, the manufacturing method being able to homogenize a material, optimize flow ability, prevent picking inside a wheel, and densify the internal structure of an aluminum forging wheel. The manufacturing method of an aluminum forging wheel includes: a billet preparation step S1 of preparing an aluminum billet to manufacture an aluminum forging wheel; a first forming step S2 of manufacturing a primary forming product by performing hot forging on the billet prepared in the billet preparation step S1; a second forming step S3 of manufacturing an aluminum forging wheel that is a secondary forming product by performing hot forging on the primary forming product manufactured in the first forming step S2; and a second machining step S5 of preheating the aluminum forging wheel manufactured in the first forming step S3 and performing F/F.

5 Claims, 4 Drawing Sheets

(56) References Cited

U.S. PATENT DOCUMENTS

| | | | | |
|---|---|---|---|---|
| 8,162,029 | B2 * | 4/2012 | Ha | B21D 22/16 164/76.1 |
| 10,144,050 | B2 * | 12/2018 | Itou | B21D 22/02 |
| 11,420,249 | B2 * | 8/2022 | Nanninga | B21D 53/30 |
| 2003/0145466 | A1 * | 8/2003 | Baek | B21D 53/30 29/894.322 |
| 2011/0127003 | A1 * | 6/2011 | Inatani | B21K 1/28 164/460 |
| 2011/0214832 | A1 * | 9/2011 | Ha | B21J 5/00 164/76.1 |
| 2011/0241414 | A1 * | 10/2011 | Ono | B60B 1/08 72/352 |
| 2017/0355009 | A1 * | 12/2017 | Itou | B21D 22/02 |
| 2019/0217376 | A1 * | 7/2019 | Nanninga | C22C 21/08 |

FOREIGN PATENT DOCUMENTS

| | | | |
|---|---|---|---|
| KR | 10-1444934 | B | 9/2014 |
| KR | 10-1511544 | B | 4/2015 |
| KR | 2021-0044545 | A | 4/2021 |

* cited by examiner

METHOD OF MANUFACTURING OF FORGED ALUMINUM WHEEL

FIELD OF THE INVENTION

The present disclosure relates to a manufacturing method of a forged aluminum wheel, more specifically, to a manufacturing method of a forged aluminum wheel, the manufacturing method being able to homogenize a material, optimize flow ability, prevent picking inside a wheel, and densify the internal structure of a forged aluminum wheel.

BACKGROUND OF THE INVENTION

In relation to the related art regarding a method of manufacturing a forged aluminum wheel, a heat treatment method of an aluminum wheel manufactured by a semi-solid forging has been disclosed in Korean Patent No. 10-0748757 (registered on Aug. 6, 2007). The heat treatment method optimizes and improves the process conditions of heat treatment that is performed after semi-solid forging, and as an improved heat treatment process, performs solidification processing that maintains 510° C. to 520° C. for 4.5 to 6 hours, performs quenching through a common method, performs aging at 150° C. to 160° C. for 5.5 hours, and then performs air cooling, thereby being able to manufacture a semi-solid forging aluminum wheel having further improved mechanical properties such as yield strength, tensile strength, and elongation.

Korean Patent No. 10-1303854 (registered on Aug. 29, 2013) relates to a method of manufacturing an aluminum wheel using hot forging to be able to simplify a process and reduce the manufacturing cost using hot forging and cold-type flow forming, and has disclosed a technology related to a method of manufacturing an aluminum wheel using hot forging to be able to simplify a process, reduce the manufacturing cost, and improve productivity by performing hot forging of making an aluminum material into a substantially aluminum wheel shape, and then immediately performing cold-type flow forming of forming a rim of the aluminum wheel without separate secondary preheating.

Korean Patent No. 10-1444934 (registered on Sep. 19, 2014) relates to an apparatus for manufacturing a hot-forged aluminum wheel for a common vehicle, the apparatus being able to perform hot forging and cold-type flow forming to be able to simplify a process and reduce the manufacturing cost, and has disclosed a technology related to an apparatus for manufacturing a hot-forged aluminum wheel for a common vehicle to be able to simplify a process, reduce the manufacturing cost, and improve productivity by newly improving a manufacturing facility to be able to perform hot forging of making an aluminum material into a substantially aluminum wheel shape, and then immediately perform cold-type flow forming of forming a rim of the aluminum wheel without separate secondary preheating.

Korean Patent Application Publication No. 10-2021-0044545 (published on Apr. 23, 2021) relates to a method of manufacturing a high-strength semi-solid forging light wheel by applying flow forming for manufacturing a wheel for common vehicle, and has disclosed a method of manufacturing a forged light wheel that includes: heating a material; feeding the heated material into a semi-solid forging mold and making a preform by performing semi-solid forging on the fed material; and manufacturing a light wheel by performing flow forming on the preform, and decreases the rim width of the wheel and performs pre-processing, thereby being able to reduce the production cycle, improve the mechanical strength of the rim, and decrease consumption of a material that was unnecessarily fed due to a minimum draft angle for taking a product out of a mold in the related art.

Korean Patent No. 10-1511544 (registered on Apr. 7, 2015) has disclosed a method of manufacturing a forged product using an aluminum alloy, the method including: a first step of producing a clean molten metal by dissolving an ingot of an aluminum alloy and then performing degassing and fluxing; a second step of manufacturing a circular billet by inserting the molten metal into a preheated continuous casting mold; a third step of manufacturing a preform using a direct extruder after preheating the manufactured circular billet; a fourth step of cutting the manufactured preform into a predetermined length and then machining both sides and rounding corners; a fifth step of preheating the machined preform and then seating the preform on a preheated mold; a sixth step of manufacturing a forged product by performing hot forging on the preform seated on the mold using a forging machine, etc.; a seventh step of trimming and then cleansing the manufactured forged product; and an eight step of completing the forged product by performing heat treatment on the cleansed forged product.

SUMMARY OF THE INVENTION

An objective of the present disclosure is to manufacture an aluminum wheel by homogenizing an aluminum wheel and optimizing flow ability by preheating a material up to a predetermined temperature when manufacturing an aluminum wheel.

Another objective of the present disclosure is to increase formability by solving problems such as material burning on a mold by maintaining a mold at a predetermined temperature in forging.

Another objective of the present disclosure is to densify the alloy structure in an aluminum wheel by performing hot forging two times.

Another objective of the present disclosure is to provide high rigidity, strength, and shock resistance by making structure particles fine and dense by applying forced rolling on a rim in the step of flow forming.

The present disclosure has been made in an effort to achieve the objectives and has the following configuration.

The present disclosure relates to a manufacturing method of a forged aluminum wheel that includes: a billet preparation step S1 of preparing an aluminum billet to manufacture a forged aluminum wheel; a first forming step S2 of manufacturing a primary forming product by performing hot forging on the billet prepared in the billet preparation step S1; a second forming step S3 of manufacturing a forged aluminum wheel that is a secondary forming product by performing hot forging on the primary forming product manufactured in the first forming step S2; and a second machining step of preheating the forged aluminum wheel manufactured in the second forming step S3 and performing flow forming.

The present disclosure further includes a first machining step S4 of trimming and diameter-enlarging the forged aluminum wheel manufactured in the second forming step S3 and of performing pre-NC machining after the second forming step, and the second machining step S5 is performed after the first machining step S4.

The billet preparation step S1 of the present disclosure cuts S1-2 a billet to correspond to a volume of an aluminum wheel to be manufactured with an aluminum billet provided S1-1, and feeds S1-3 the billet into a preheating furnace to preheat the billet.

In the present disclosure, the first forming step S2 preheats S2-1 the billet prepared to manufacture a forged aluminum wheel in a preheating furnace, preheats S2-2 a mold for manufacturing a forged aluminum wheel, and manufactures S2-3 a primary forming product by performing hot forging one time at a pressure over 4,000 tons and under 6,000 tons through a forging machine.

In the present disclosure, the second forming step S3 preheats S3-1 the primary forming product manufactured in the first forming step S2 in a preheating furnace, preheats S3-2 a mold for manufacturing the forged aluminum wheel, and manufactures S3-3 a secondary forming product by performing hot forging one time at a pressure over 6,000 tons and under 10,000 tons through a forging machine.

In the present disclosure, preheating temperature in the preheating S2-1 of the billet prepared to manufacture a forged aluminum wheel in a preheating furnace is within 400-510° C., and preheating temperature in the preheating S2-2 of a mold for manufacturing a forged aluminum wheel is within 300-430° C.

In the present disclosure, preheating temperature in the preheating S3-1 of the primary forming product manufactured in the first forming step S2 in a preheating furnace is within 400-510° C., and preheating temperature in the preheating S3-2 of a mold for manufacturing the forged aluminum wheel is within 300-430° C.

DETAILED DESCRIPTION OF THE INVENTION

The present disclosure relates to a manufacturing method of an aluminum wheel that includes: a billet preparation step S1 of preparing an aluminum billet to manufacture a forged aluminum wheel; a first forming step S2 of manufacturing a primary forming product by performing hot forging on the billet prepared in the billet preparation step S1; a second forming step S3 of manufacturing a forged aluminum wheel that is a secondary forming product by performing hot forging on the primary forming product manufactured in the first forming step S2; a first machining step S4 of trimming and diameter-enlarging the forged aluminum wheel manufactured in the second forming step S3 and of performing pre-NC machining S4; and a second machining step S5 of preheating the forged aluminum wheel manufactured in the second forming step S3 and of performing flow forming. The steps are described hereafter in detail with the drawings.

[Billet Preparation Step S1]

Figure 11:
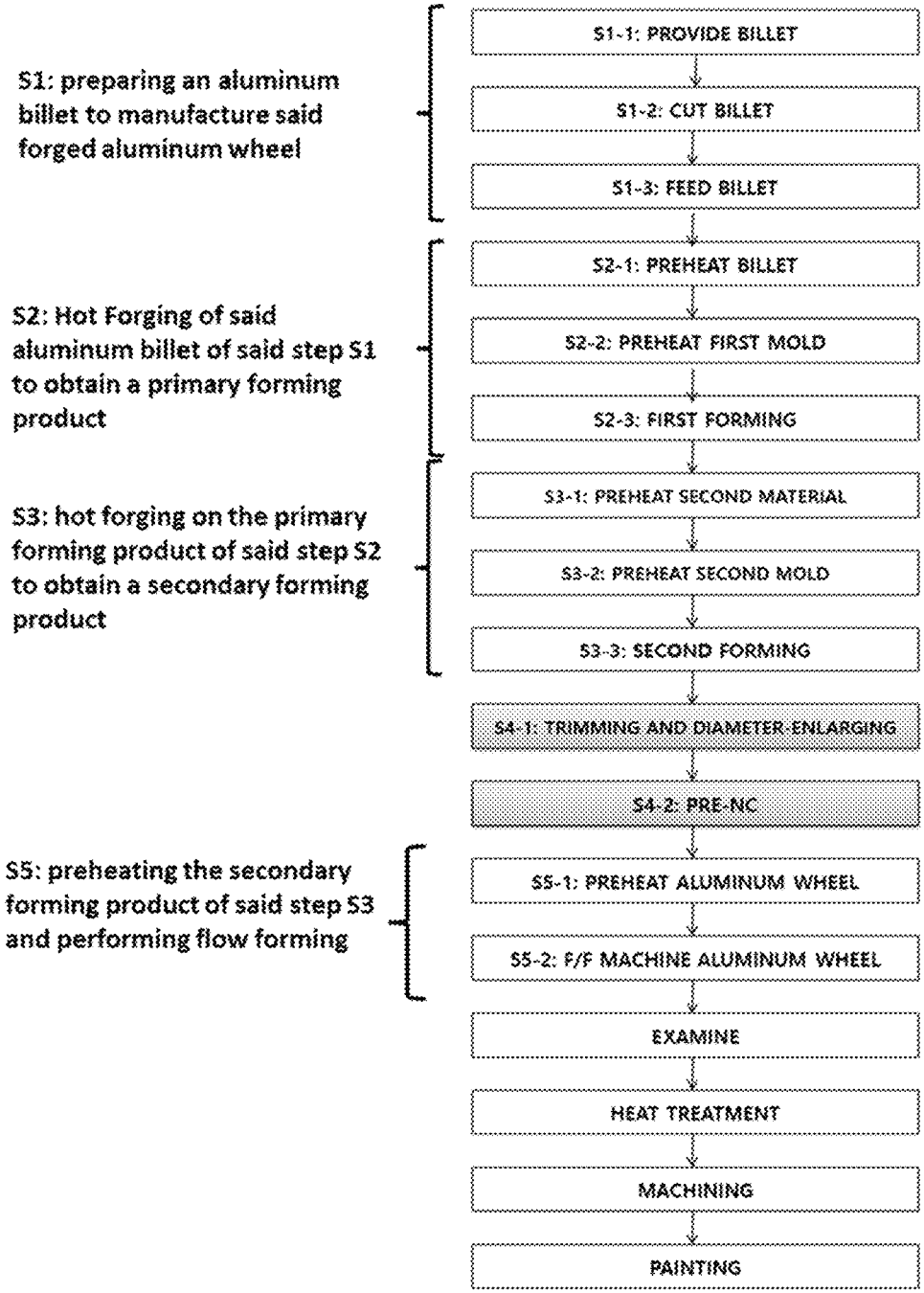
FIG. 11 is a flowchart of a manufacturing method of the present disclosure.

The billet preparation step S1 of the present disclosure, as indicated by S1-1 to S1-3 in FIG. 11, is a step of providing S1-1 a billet, cutting S1-2 the provided billet into the size of an aluminum wheel to be manufactured, and feeding S1-3 the billet into a preheating furnace to preheat the billet.

In the cutting S1-2 of the billet, the volume of an aluminum wheel to be manufactured is calculated and then the billet is cut to correspond to the volume.

Figure 1:
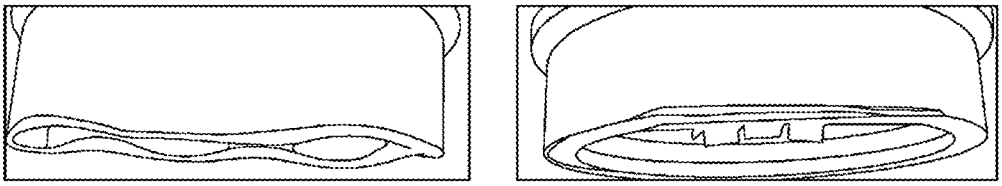
FIG. 1 is a picture when a billet was cut smaller than the volume of an aluminum wheel and then forged.

When the billet is cut smaller than the volume of an aluminum wheel to be manufactured, incomplete forming occurs due to shortage of material, so, as shown in FIG. 1, the end of the rim is not fully filled, whereby an aluminum wheel is not formed in a complete shape.

Next, the billet cut as described above is fed S1-3 into a preheating furnace for forging.

[First Forming Step S2]

The first forming step S2 of the present disclosure, which is indicated by S2-1 to S2-3 in FIG. 11, is to forge the billet prepared in the billet preparation step S1.

First, the billet fed into the preheating furnace in the billet preparation step S1 is preheated up to a temperature of 400-510° C. (S2-1).

Figure 2:
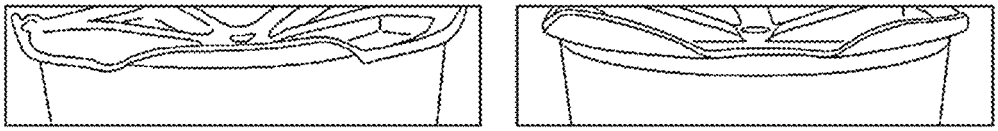
FIG. 2 is a picture when preheating was performed out of a preheating temperature range of a billet and then forged.

Preheating the billet in this way is for homogenizing the material and optimizing flow stress. When a temperature comes out of the preheating temperature range (400-510° C.) of the billet, as shown in FIG. 2, a product is not completely formed due to shortage of fluidity of a material in forming.

Next, a mold is preheated up to 300-430° C. before forging (S2-2).

Figure 3:
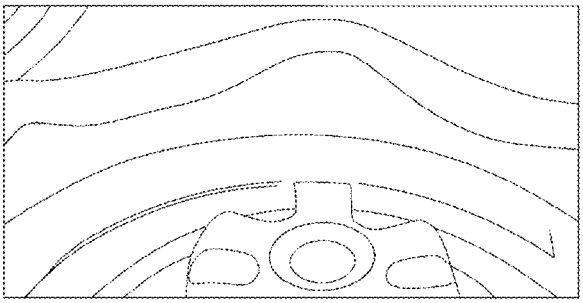
FIG. 3 is a picture when preheating was performed out of a preheating temperature range of a mold and then forged.

The reason of preheating the mold into the temperature range is because when a temperature exceeds or does not reach the temperature range, as shown in FIG. 3, the billet in the temperature range of 400-510° C. is burned on the mold and is not taken out or forming is not completely performed due to non-uniform flow of the material.

Next, first forming is performed after the billet is preheated and the mold is preheated (S2-3).

Figure 4:
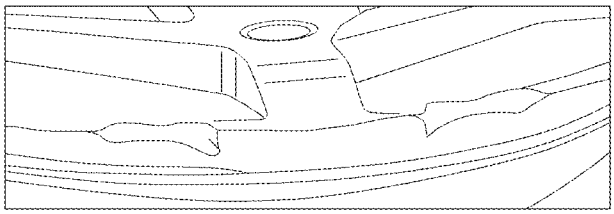
FIG. 4 is a picture when forging was performed at a forging pressure below reference in first forming.

The first forming is performed by performing hot forging one time through a forging machine over 4,000 tons and under 6,000 tons. The purpose of the first forming is to uniformly distribute the billet before the second forming. In this case, when the pressure is under 4,000 tons, metal flow is stopped due to shortage of pressure, so non-forming is generated, and as shown in FIG. 4, the structure in the aluminum alloy is not densified.

[Second Forming Step S3]

The second forming step S3 of the present disclosure, which is indicated by S3-1 to S3-3 in FIG. 11, is performed under the same conditions as the first forming step S2.

That is, the product first formed through the first forming step S2 is preheated up to 400-510° C. in the preheating furnace (S3-1) and a mold for second forming is preheated up to 300-430° C. (S3-2). Then, forging is performed one time through a forging machine over 6,000 tons and under 10,000 tons (S3-3).

Figure 5:
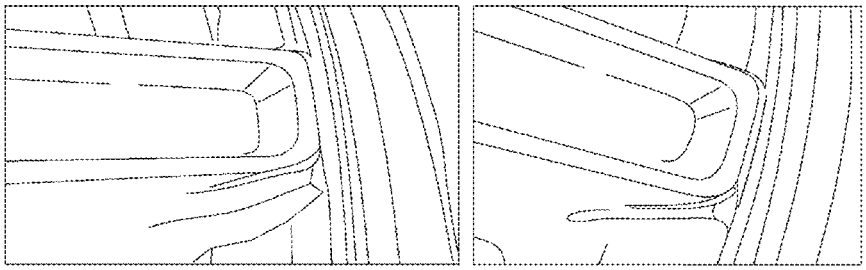
FIG. 5 is a picture when forging was performed at a forging pressure below reference in second forming.

The purpose of the second forming is to forge the billet into a final aluminum wheel shape. In this case, when the pressure is under 6,000 tons, the structure in the aluminum alloy is not densified due to shortage of pressure, so, as shown in FIG. 5, a narrow and dense shape is not completely formed, whereby a spoke may not be formed.

[First Machining Step S4]

The first machining step S4 of the present disclosure, which is indicated by S4-1 to S4-2 in FIG. 11, is a step of machining the aluminum wheel manufactured in the second forming step.

The first machining step S4 in the present disclosure is not necessary, and it is possible to achieve the objectives of the present disclosure even by performing only the second machining step.

The first machining step S4 performs trimming of removing an unnecessary material from the aluminum wheel manufactured in the second forming step S3, and enlarges the diameter of the rim for smooth flow forming (F/F) in the next step (S4-1).

Next, pre-NC is performed on the aluminum wheel trimmed and diameter-enlarged to stably secure the product in flow forming (F/F) and achieve a uniform rim thickness (S4-2).

The reason of performing pre-NC is for improving stability of seating and making the thickness of the rim uniform because only hot forging is performed in the first forming step S2 and the second forming step S3, so an aluminum wheel completed through only hot forging has a rough surface so as not to be stably seated and has an uninform rim thickness.

Figure 6:
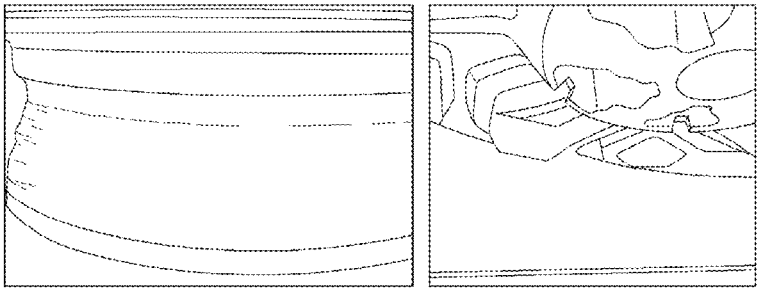
FIG. 6 is a picture of an aluminum wheel before pre-NC machining.
Figure 7:
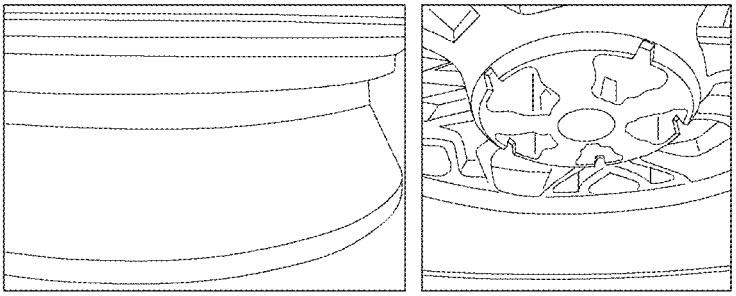
FIG. 7 is a picture of an aluminum wheel after pre-NC machining.

FIG. 6 is a picture of an aluminum wheel before pre-NC machining and FIG. 7 is a picture of an aluminum wheel after pre-NC machining

[Second Machining Step S5]

The second machining step S5 of the present disclosure, which is indicated by S5-1 to S5-2 in FIG. 11, may be performed after the first machining step S4 or may be performed after the second forming step S3 without performing the first machining step S4.

The second machining step S5 is started with preheating the aluminum wheel (S5-1) formed in the second forming step S3. In this case, a preheating condition is to preheat the aluminum wheel up to 360-380° C. slightly lower than the preheating temperature in the first forming step S2 and the second forming step S3 (S5-1).

When the second machining step S5 is performed after the first machining step S4, the aluminum wheel machined through the first machining step S4 is preheated (S5-1).

This is because when preheating is performed within the temperature range described above, fluidity of the material can be optimally maintained in flow forming (F/F).

Figure 8:
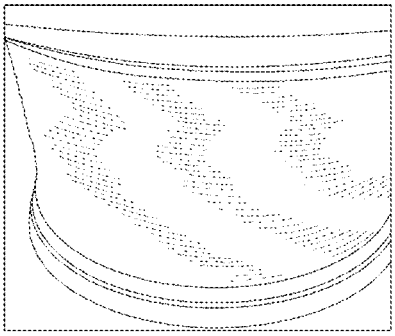
FIG. 8 is a picture when preheating was performed out of a preheating temperature of step S5 and then flow forming was performed.

As shown in FIG. 8, when a temperature comes out of the temperature range below the lower limit of the temperature range, non-forming may be generated, and when the temperature exceeds the temperature range, a wheel is twisted.

Figure 9:
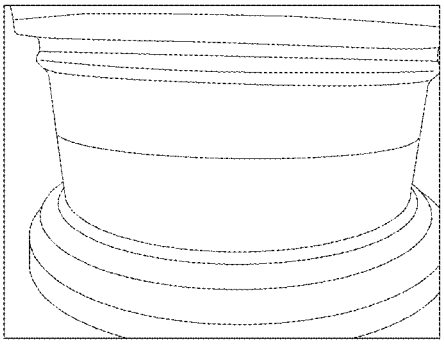
FIG. 9 is a picture when preheating was performed within a preheating temperature of step S5 and then flow forming was performed.
Figure 10:
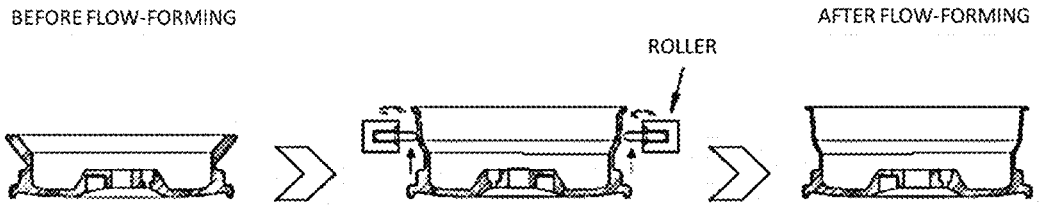
FIG. 10 is a picture of an embodiment of flow forming.

FIG. 9 is a picture showing an aluminum wheel that has undergone flow forming (F/F) after preheating within the temperature range.

After the preheating step S5-1, flow forming (F/F) S5-2 is performed. flow forming (F/F), as shown in FIG. 5, is to make the particles of a structure fine and dense by applying forced rolling on a rim, whereby higher rigidity, strength, and shock resistance are achieved.

[Post-Processing Step]

According to the present disclosure, a forged aluminum wheel is manufactured through the billet preparation step S1 to the second machining step S5, as described above.

After the second machining S5, examining, heat treatment, machining, and painting may be performed as post-processing steps.

The examining step, which is for checking cracks, defects, etc. that may exist on the surface of the forged aluminum wheel, may be performed through common fluorescent penetrant inspection (fluorescent penetration, penetration test).

The heat treatment step is to perform heat treatment on the aluminum wheel manufactured through the steps described above. In this case, it is preferable that the heat treatment is performed in a T6 type that performs artificial aging after solution treatment.

The machining step machines the rim to form a portion on which a tire is seated and a portion that is mounted on the hub of a vehicle.

Finally, the painting step may be selected from various common painting methods.

As described above, the present disclosure was described through embodiments with reference to the accompanying drawings, but the embodiments are preferred embodiment, so the present disclosure is not limited to the embodiments, and the protection range of the present disclosure should be understood as the following claims and an equivalent concept.

The present disclosure can manufacture an aluminum wheel by homogenizing an aluminum wheel and optimizing flow ability by preheating a material up to a predetermined temperature when manufacturing an aluminum wheel.

Further, the present disclosure can increase formability by solving problems such as material burning on a mold by maintaining a mold at a predetermined temperature in forging.

Further, the present disclosure can densify the alloy structure in an aluminum wheel by performing hot forging two times.

Further, the present disclosure can manufacture a forged aluminum wheel that provides high rigidity, strength, and shock resistance by making structure particles fine and dense by applying forced rolling on a rim in the step of flow forming.

While the present invention has been described with respect to the specific embodiments, it will be apparent to those skilled in the art that various changes and modifications may be made without departing from the spirit and scope of the invention as defined in the following claims.

What is claimed is:

1. A manufacturing method of a forged aluminum wheel, comprising the steps of:

S1: preparing an aluminum billet to manufacture said forged aluminum wheel;

S2: performing hot forging on said aluminum billet of said step S1 to obtain a primary forming product;

S3: performing hot forging on the primary forming product of said step S2 to obtain a secondary forming product; and S5: preheating the secondary product of said step S3 and performing flow forming;

wherein said step S2 comprises the steps of:

S2-1: preheating said aluminum billet of said step S1 in a preheating furnace;

S2-2: preheating a first mold for manufacturing said aluminum wheel; and

S2-3: manufacturing said primary forming product by performing hot forging one time at a pressure over 4,000 tons and under 6,000 tons through a forging machine; and wherein said step S3 comprises the steps of:

S3-1: preheating the primary forming product of said step S2 in a preheating furnace;

S3-2: preheating a second mold for manufacturing the forged aluminum wheel; and

S3-3: manufacturing said secondary forming product by performing hot forging one time at a pressure over 6,000 tons and under 10,000 tons through a forging machine.

2. The manufacturing method of claim 1, further comprising the step of:

S4: trimming and diameter-enlarging said secondary forming product of said step S3 and performing pre-NC machining after said step S3;

wherein said step S5 is performed after said step S4.

3. The manufacturing method of claim 1, wherein said step S1 comprises the steps of:

S1-1: providing an aluminum billet;

S1-2: cutting said aluminum billet to correspond to a volume of said forged aluminum wheel; and S1-3: feeding said aluminum billet of said step S1-2 into a preheating furnace.

4. The manufacturing method of claim 1, wherein said preheating of said step S2-1 is within 400-510° C.; and said preheating of said step S2-2 is within 300-430° C.

5. The manufacturing method of claim 1, wherein said preheating of said step S3-1 is within 400-510° C.; and said preheating of said step S3-2 is within 300-430° C.

* * * * *